United States Patent [19]

Moulin et al.

[11] Patent Number: 4,996,543

[45] Date of Patent: Feb. 26, 1991

[54] PRECISION MEDIUM HANDLING SYSTEM AND METHOD FOR A RECORDER

[76] Inventors: Michel Moulin; Marcello Baseggio, both of c/o Versitec S.A., Avenue des Baumettes 17, CH-1020 Renens, Switzerland

[21] Appl. No.: 461,345

[22] Filed: Jan. 5, 1990

[30] Foreign Application Priority Data

Feb. 10, 1989 [GB] United Kingdom ..... 8903051

[51] Int. Cl.[5] ..... B41B 19/00

[52] U.S. Cl. ..... 354/5

[58] Field of Search ..... 354/5; 346/108

[56] References Cited

U.S. PATENT DOCUMENTS 4,553,825 11/1985 Moulin et al. ..... 354/5

4,746,942 5/1988 Moulin ..... 354/5

4,819,018 4/1989 Moyrout et al. ..... 354/5

*Primary Examiner*—Michael L. Gellner

*Attorney, Agent, or Firm*—Gregor N. Neff

[57] ABSTRACT

Accurate control of the lateral position and spacing of a photosensitive medium is provided for recording a succession of lines representing graphic images or portions thereof, without mechanical edge guides. The apparatus includes an optical edge detector, a film drive assembly having two independently-controlled feed units, and a deviation correction means to correct the position prior to actual printing of images. Preferably, a triangulation method is used to electronically correct the drive path of the medium. Error-correction is obtained by the combined action of the two independent feed units operated by an electronic control circuit receiving signals generated by the optical edge detector. The apparatus also includes means to maintain the image receiving section of the photosensitive medium in a flat plane. An image placement carriage carrying optical elements is supported on magnetic slider pads forming bearing elements which hold the carriage onto smooth tracks made of magnetic material, thus minimizing or eliminating vibrations from the motion of the carriage and improving the quality of the images formed on the photosensitive medium.

39 Claims, 7 Drawing Sheets

FIG. 4
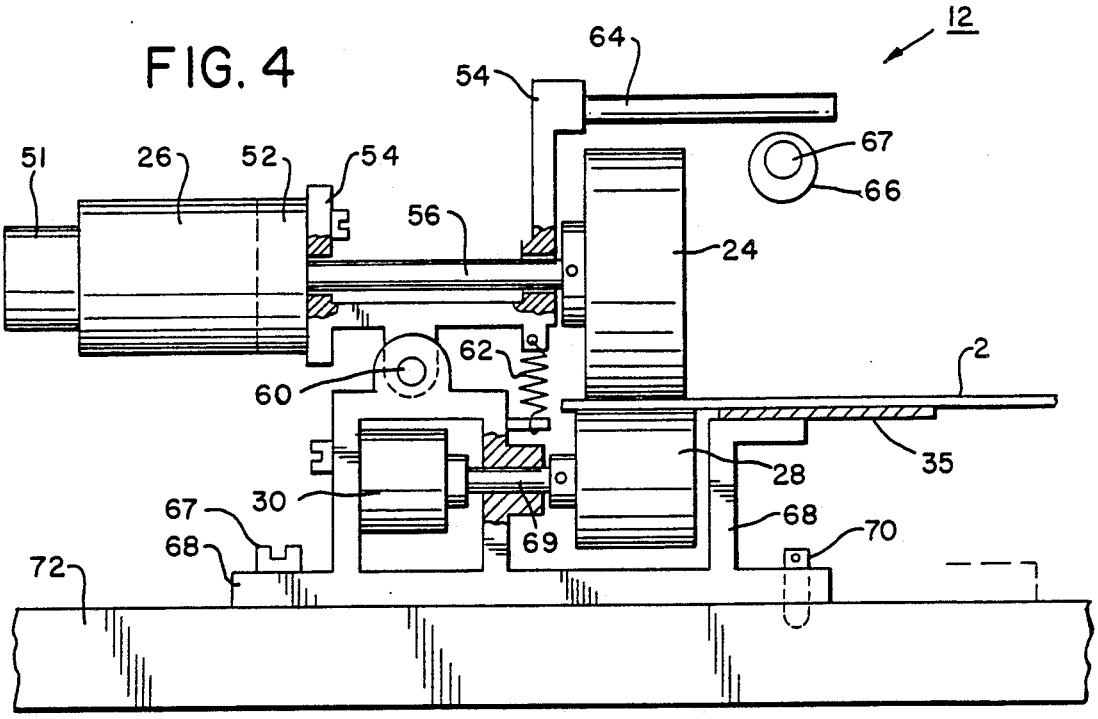
FIG. 7
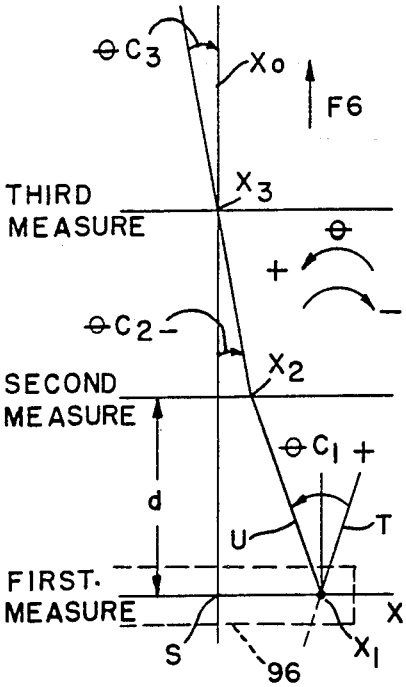
FIG. 8
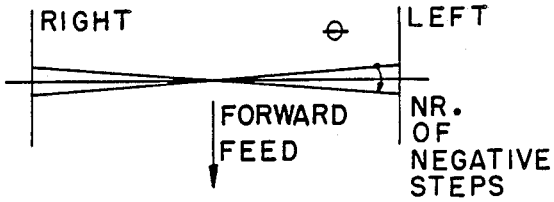
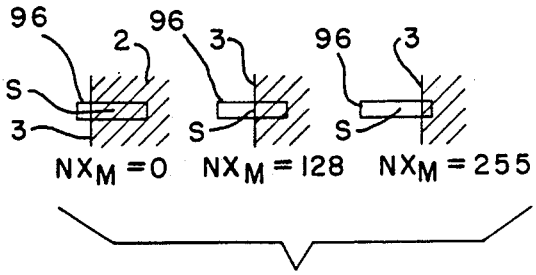
FIG. 9

FIG. 11
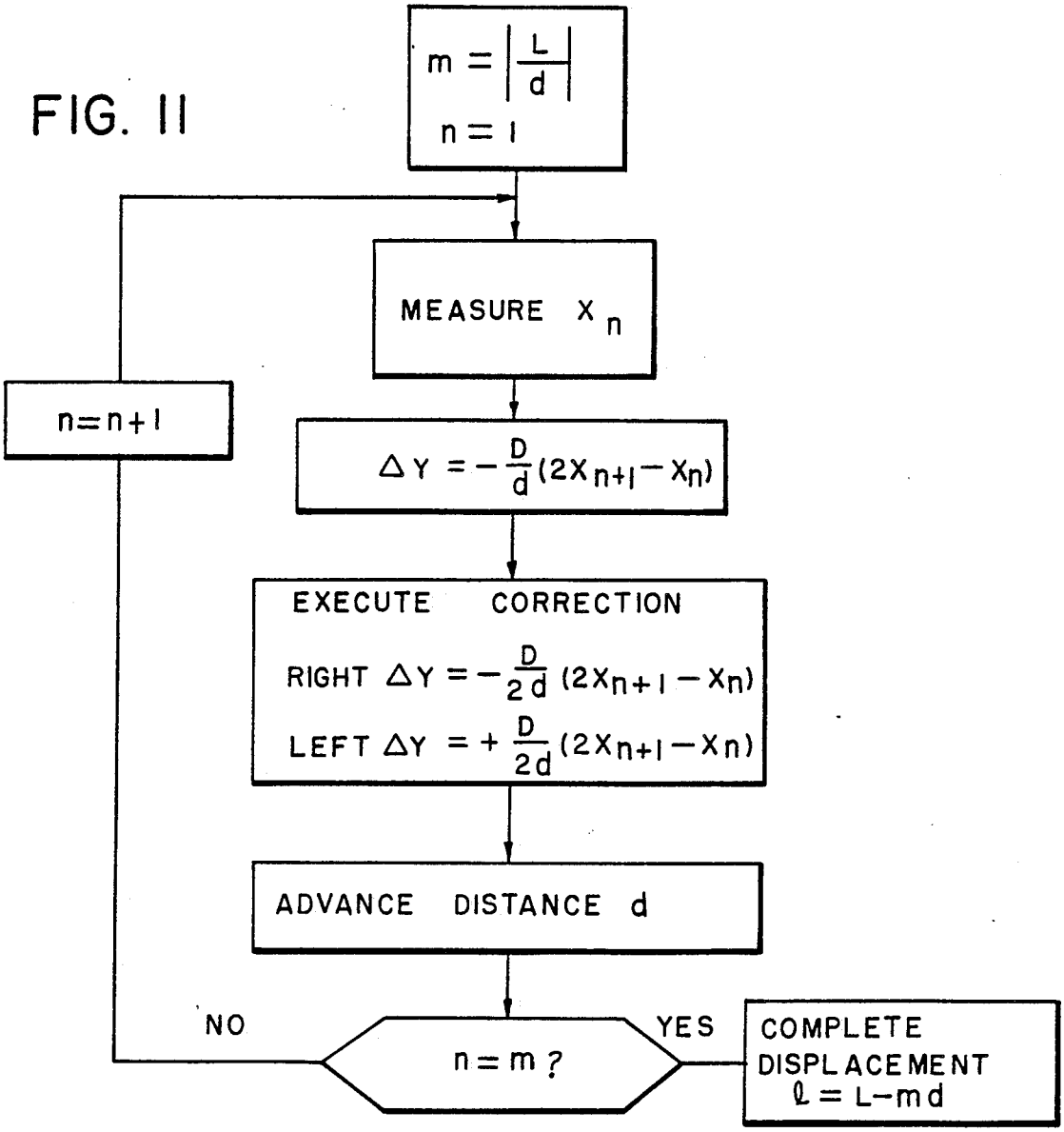
FIG. 5A
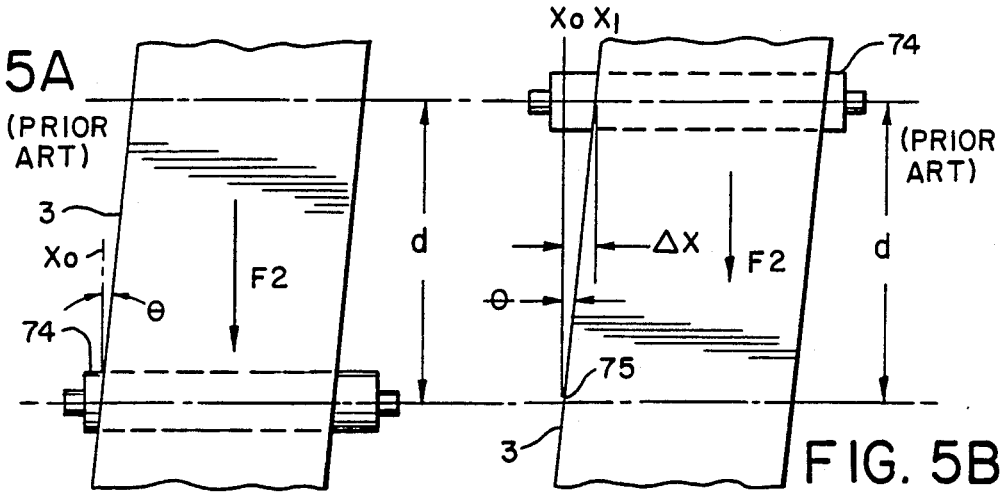
FIG. 5B

FIG. 12
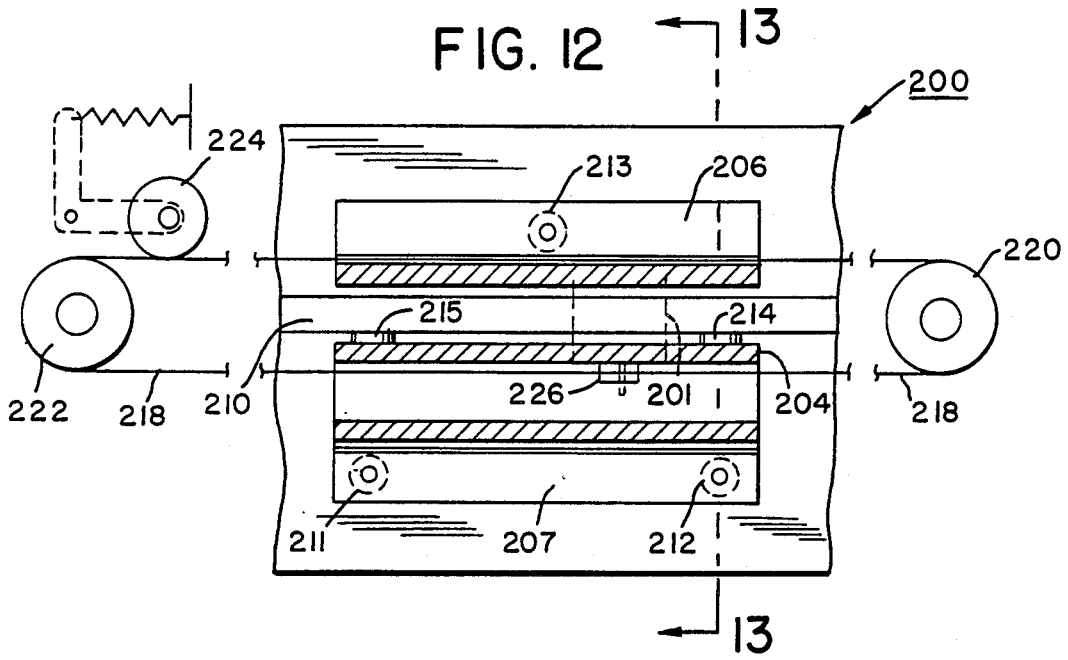
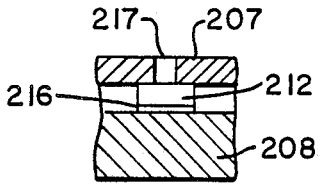
FIG. 14
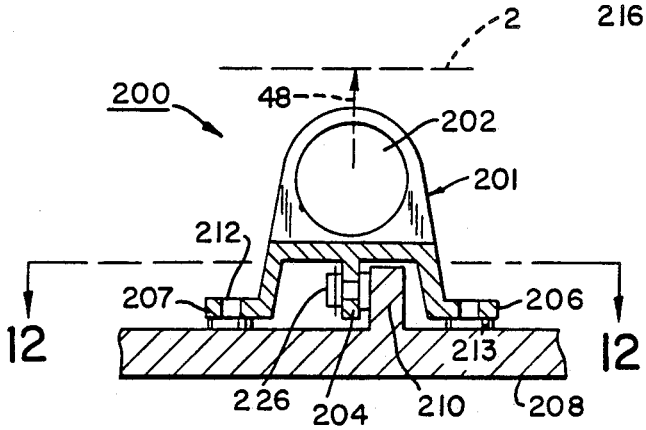
FIG. 13

PRECISION MEDIUM HANDLING SYSTEM AND METHOD FOR A RECORDER

FIELD OF THE INVENTION

The present invention relates generally to medium handling and image formation systems and methods and, more particularly, to transport systems and methods in which a photosensitive medium is accurately transported through an imaging zone.

The subject matter of the present invention is particularly advantageous when used in laser photocomposing systems, especially those shown in U.S. Pat. Nos. 4,746,942 and 4,819,018.

Although the following description concerns laser image formation, the invention is equally applicable to any kind of machine requiring the accurate advance and positioning of images on an image-receiving medium. The invention applies to a medium in roll or web form as well as in sheet form. Therefore, the present invention is applicable to imagers of any kind, including electrophotographic printers, ink jet printers, phototypesetters and other impact or non-impact imaging devices.

The term "paper" or "film", as used throughout this specification, denotes any suitable image recording medium, including printing plates, such as zinc oxide offset plates, and intermediate image transferring systems, such as electrophotographic belts.

DESCRIPTION OF THE PRIOR ART

Phototypesetters, line printers, laser imagers and the like are now widely used in conjunction with computers to produce hard copy output on an appropriate medium. In most of the prior art machines, more particularly in phototypesetters, the medium is paper or film, generally in roll form which is utilized to obtain outputs of the highest typographic quality.

Attempts have been made in the past to obtain better tracking of the paper from the supply cassette to the receiving cassette, and thereby reduce the inaccuracies in the movement. Most of these inaccuracies are caused by the wandering of the paper roll within the supply cassette, which causes variations of the edge margins, frequent jamming of the paper in the receiving cassette, and line spacing inaccuracies.

One prior suggestion for this purpose is to urge the paper or film against a reference flange or edge, as described in U.S. Pat. Nos. 4,179,117 and 4,553,825. A similar system is described in U.S. Pat. No. 4,221,480 in which the intermediate image carrying medium is in the form of a moving belt.

Such prior art devices usually suffer from small positioning inaccuracies due to line spacing and edge margin errors, which usually are caused by a misaligned or skewed medium or other feeding defects. Such inaccuracies may be acceptable for the composing of text matter characters of a relatively small size, but they are unacceptable for either large characters or graphics which require several successive scanning passes of the image-creating device. When several passes are required, even small inaccuracies can cause objectionable "banding" and improper abutting of the successively-produced image sections. To prevent this from happening, the position of the medium should be controlled to within a few micrometers in the X as well as in the Y direction, that is, in the direction transverse to the feed direction, as well as in the feed direction. It is believed that this result cannot be obtained with conventional paper transport systems in which the medium is subjected to physical edge margin constraints.

Character or image-forming carriages which move across the medium to position the images are also widely used in the printing or composing art, in conjunction with ink jet printers, dot printers, phototypesetters or any other kind of machine in which character segments, complete characters or pictorial elements have to be accurately positioned and spaced in sequence one after another. Such prior art carriages usually are fitted with ball bearings and are maintained on their tracks by spring means, which makes the carriages susceptible to vibrations inherent in the use of ball bearings and springs. The vibrations also cause inaccuracy in the positioning of image-forming elements on the medium.

OBJECTS OF THE INVENTION

It is, therefore, an object of this invention to provide a new medium transport and accurate positioning system and method eliminating or minimizing the problems set forth above. It is an object to provide such a system and method in which the medium is not subjected to the stress caused by physically forcing it to follow a straight path by the use of mechanical guides, and yet permits the medium to be moved at a relatively high speed without deterioration of the positioning accuracy.

Another object of the invention is to provide an image forming carriage mechanism with relatively low vibration, light weight and accurate movement, and relatively low cost.

SUMMARY OF THE INVENTION

In accordance with the present invention, there is provided a transport system and method in which a medium is moved along a predetermined track with a high degree of precision without the use of mechanical edge guides or flanges.

Preferably, optical detection means is used to detect the position of the medium, specifically, the position of a reference line such as its edge, and produce position-indicating electrical signals which are used by an electrical system to correct the direction of travel of the medium and keep it moving along the desired track.

A further object of the invention is to provide an image formation device and method, particularly a laser photocomposition device and method, in which the photosensitive medium and image placement means are moved extremely accurately and smoothly to produce extremely high-quality images at a high speed, without damage to the medium.

Preferably a triangulation process is used to correct the direction of travel of the medium.

It also is preferable that the transport system and method use two independently-controlled, laterally-spaced drive assemblies with electronic means responsive to the output of the optical detection means to independently control the drive assemblies to keep the medium moving along the desired track with great precision.

According to another feature of the invention, the accurate positioning of the medium at the image receiving station is insured by photoelectronic feedback means including a photodetector assembly with means to automatically compensate for opacity variations of different media.

In accordance with another feature of the invention each driving unit is located near one edge of the medium and comprises a driving roller and a pinch roller, and an encoder or other metering device driven by the pinch roller. The pinch roller is of relatively low inertia and is free to rotate on its axis in intimate contact with the face of the medium which will receive images, for example the emulsion side of a photosensitive material, so that it is driven exclusively by the controlled friction between its outer surface and the image-receiving surface of the medium. Thus, the encoder driven by the pinch roller accurately measures the movement of the medium.

The present invention is further characterized by a new film metering assembly actuated by a roller pressed against the emulsion side of the film with a force so determined as to avoid any slippage, taking into account the inertia of the rotating assembly, its acceleration in a start-stop machine, and the friction torque of the metering assembly.

According to yet another feature of the invention, the driving units are pivotally attached to a member extending across the width of the medium. The member and driving units can be lifted away from engagement with the medium and the metering roller in order to leave a gap and thus facilitate the insertion of a fresh supply of the medium.

A further feature of the invention is to insure accurate and parallel motion of the recording medium by the use of two self-contained driving units which can be selectively positioned across the width of the medium so that each unit is located close to one edge, and controlling the driving units in order to produce substantially symmetrical moving forces to advance the medium.

Yet another feature of the invention is to monitor the advance of the medium to detect any accidental slippage of one pinch roller unit relative to the other and to utilize photoelectric detection means to introduce a correction.

In another embodiment of the invention more particularly suited for handling a flexible web such as photographic paper, a loop is formed in the web prior to its passage through the imaging zone. This makes it easier to correct the lateral position of the image-receiving portion of the web by eliminating the effects of the inertia of the supply roll and the friction caused by any light baffles which may be used in the machine in which the web is used.

In a further embodiment using a flexible web, a sufficient amount of material is first pulled out from the supply unit to form an output loop between the imaging zone and the output unit. If necessary, the web is moved back and forth past an optical position sensor and correction means, thus performing multiple corrections until the web is accurately positioned for receiving images. The loop formation minimizes the effects of friction, etc., in the correction process.

Alternating forward and backward movement of the web past an exposure station can be used to compose columnar text or graphic images. The correction means maintains an accurately located margin at all times.

The two drive units preferably are controlled to operate in a "push-pull" mode to correct any deviation of the medium from its desired position.

According to another feature of the invention, sufficient space is provided between the supply and output cassettes and the feed rollers for the formation of two film loops. Control means are provided to form the output-side loop by operating the forward driving mechanism to force the web against a deflector plate which blocks movement of the web. The input-side loop is formed by moving the web backwards while preventing the film from re-entering the input cassette.

Another feature of the invention resides in the judicious use of the relative flexibility of the medium to maintain its image-receiving portion in a rigid plane against a platen substantially located on the imaging or focus plane of the apparatus.

According to yet another feature of the invention, the images are accurately positioned across the width of the medium by a novel shuttling carriage and supporting guide structure for carrying the image projection means. This image positioning means is relatively simple and low in cost, while providing accurate displacement with relatively low friction and a minimum of vibration and "play."

These improvements preferably are obtained, in part, by the use of several slider pads as bearings between the carriage and guide structure. Each slider pad preferably is a permanent magnet with a small wafer or coating of low-friction material on its bearing surface. The wafer is made of pre-lubricated plastic and has a high resistance to wear. The carriage is made of a very light-weight material and its structure insures excellent rigidity. The guide structure is made of magnetic material, such as cast iron. The magnetic attraction between the slider pads and the guide structure hold the carriage against the surfaces of the guide structure without the use of springs. Thus, the vibration and "play" of the usual ball bearings and spring are avoided.

Other objects, features and advantages of this invention will be set forth in or apparent from the following description and drawings, and the appended claims.

BRIEF DESCRIPTION OF THE DRAWINGS

FIG. 4 is a partially schematic, partially cross-sectional view of one of the drive units shown in FIG. 1;

FIGS. 5A and 5B are schematic plan views of prior art devices illustrating the displacement of a skewed film with a single roller drive;

FIGS. 7 and 8 are schematic diagrams, similar to FIG. 6, useful in the understanding of the method of the invention which is used to compensate for margin deviation;

FIG. 9 is a schematic diagram representing the relative location of the film margin and the photodetector of the invention;

FIG. 11 is a flow chart of a computer program for performing the preferred correction method;

FIG. 12 is a cross-sectional, partially schematic plan view of the imaging carriage of the invention;

FIG. 13 is a cross-sectional view taken along line 13—13 of FIG. 12; and

FIG. 14 is an enlargement of a portion of FIG. 13.

DETAILED DESCRIPTION

Figure 1:
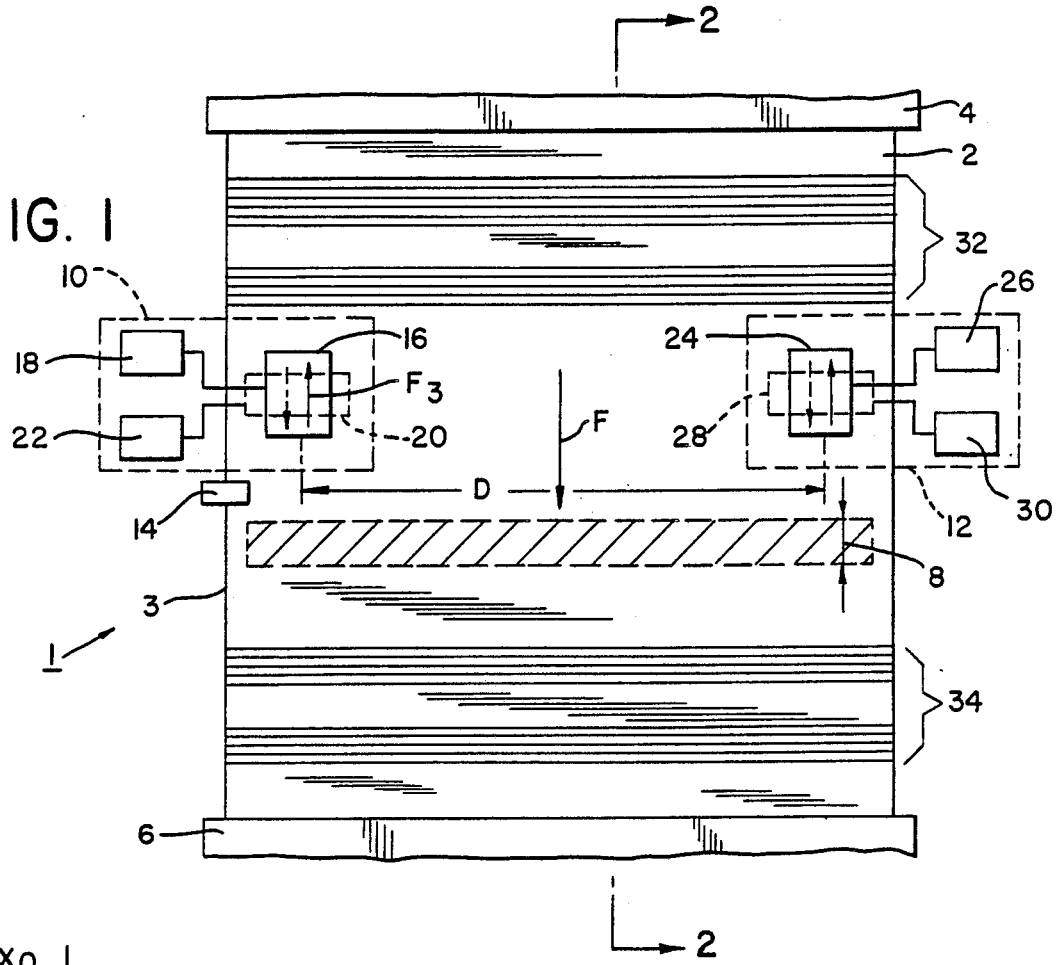
FIG. 1 is a partially schematic plan view of the preferred film driving system and method of the present invention.

FIG. 1 is a schematic plan view of the film drive system 1 of the invention. The system 1 preferably is part of an imaging device (not shown) such as a laser phototypesetter, a printer, or other such device. The invention is used to advantage in a laser phototypesetter such as that shown in U.S. Pat. Nos. 4,746,942 or 4,819,018 in which images are formed on photographic film or other media by sweeping a laser "brush" having multiple laser beams across a photographic surface. The disclosures of those patents hereby are incorporated herein by reference.

In the system 1, photographic film or another photosensitive medium 2 (also see FIGS. 2-3) is fed from an input cassette 4 to an output cassette 6 by two independent feed units, a left-hand drive unit 10 and a right-hand drive unit 12. The film 2 passes through a forward film loop zone 32, an image-receiving zone 8, and a rear film loop zone 34 before reaching the output cassette. The arrow F represents the direction of forward motion of the film from the input to the output cassette.

Preferably, the left drive assembly 10 is located at a fixed location relative to the base of the machine, and the right-side drive unit 12 can be pre-positioned at different predetermined locations, depending on the width of the medium. Both drive units 10 and 12 are accurately located on a line perpendicular to the longitudinal edges or margins of the film.

Each drive unit 10, 12 is comprised of a drive roller 16 or 24 driven by a motor 18 or 26, preferably through a speed reducer (not shown in FIG. 1), and an idler or pinch roller 20 or 28 whose shaft drives a position encoder 22 or 30 which meters or measures the movement of the film.

The pinch roller 20 or 28 is in intimate contact with the light sensitive surface of the film medium that will receive images and is driven only by that medium so that any slippage between either drive roller and the medium does not affect the operation or the accuracy of the feeding device.

The left-hand film margin or edge is shown at 3. An optical positioned detector 14 is position underneath the film to detect the position of the edge 3.

Figure 2:
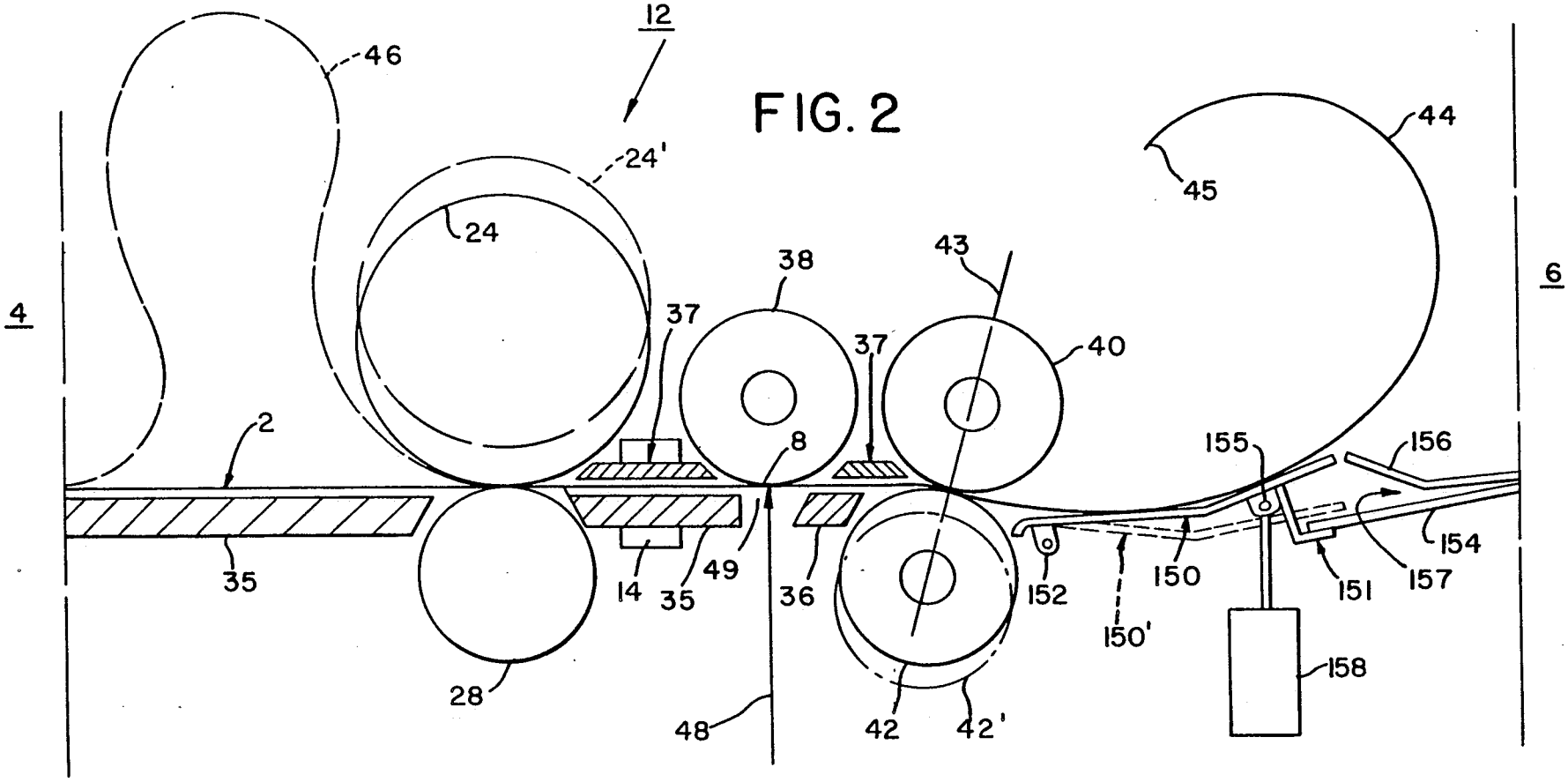
FIG. 2 is a cross-sectional, partially schematic view taken along line 2—2 of FIG. 1, illustrating the relative position of the components of the film drive system during and after the loading of new film.

FIG. 2 is a cross-sectional view taken along line 2—2 of FIG. 1, and shows the right-side drive unit 12. The optical detector 14 is shown as if it were located on the right side of the film path, instead of the left side, for the sake of illustration. FIG. 2 also shows further details of the drive system 1 which are not shown in FIG. 1.

The drive system 1 includes film track rollers 38, 40 and 42, which are preferably covered with a low friction material, and which extend the full width of the image-receiving area, and slightly beyond. Rollers 38 and 40 are at a fixed location, whereas roller 42 can be moved to disengaged position 42'. The film 2 is supported by support plates 35, 36, preferably teflon-covered. There is a transverse gap 49 between the plates which allows the image-forming light to reach the image-receiving area 8 of the film 2. Further plates 37 above the film prevent the film from buckling upwardly.

INITIALIZATION

The output cassette 6 has upper and lower entrance guide plates 156 and 154 forming an inlet 157 to the cassette. A deflector plate 150 is pivoted at 152 to the frame (not shown) of the drive system 1.

The plate 150 can be moved upwardly from the idle position 150' shown in dashed lines to the operative position shown in solid lines by a solenoid 158 whose plunger is thrust upwardly against a spring (not shown) when energized. The deflector plate 150 has an L-shaped projection extending downwardly from its right end. The lower portion of the projection 151 is positioned to engage the underside of the edge of plate 154 to limit the motion of the deflector plate 150 when the latter is raised by the solenoid.

When a new input cassette 4 is loaded, in order to facilitate the insertion of the film, the left and right drive units 10 and 12, and all other drive elements are moved out of the film path. Specifically, the drive rollers 16 and 24 are lifted to a position such as 24' by a lifting mechanism (not shown), leaving room for the introduction of the leading edge of film. The track roller 42 is also moved away from its active position to a disengaged position 42'. The film is manually inserted along lower support plates 35 and 36 and under support plates 37, and between track rollers 40 and 42'.

To complete the loading procedure, the drive and track rollers 24 and 42 are returned to their operating positions. With the deflector plate 150 raised to the solid-line position shown in FIG. 2, the film is driven forwardly to form an output film loop 44 of pre-determined length. Then, the feeding mechanism is reversed. Because of the friction from light baffles, etc., the film will not re-enter the supply cassette 4 when it is moved backwardly. Thus, the film forms a loop 46 (FIG. 2) at the input end of the feed mechanism.

The film is no in position to begin the imaging process. Preferably, the automatic margin correction process is performed during these initializing operations so that the film is accurately positioned at the start of the imaging process.

IMAGING PROCESS

Figure 3B:
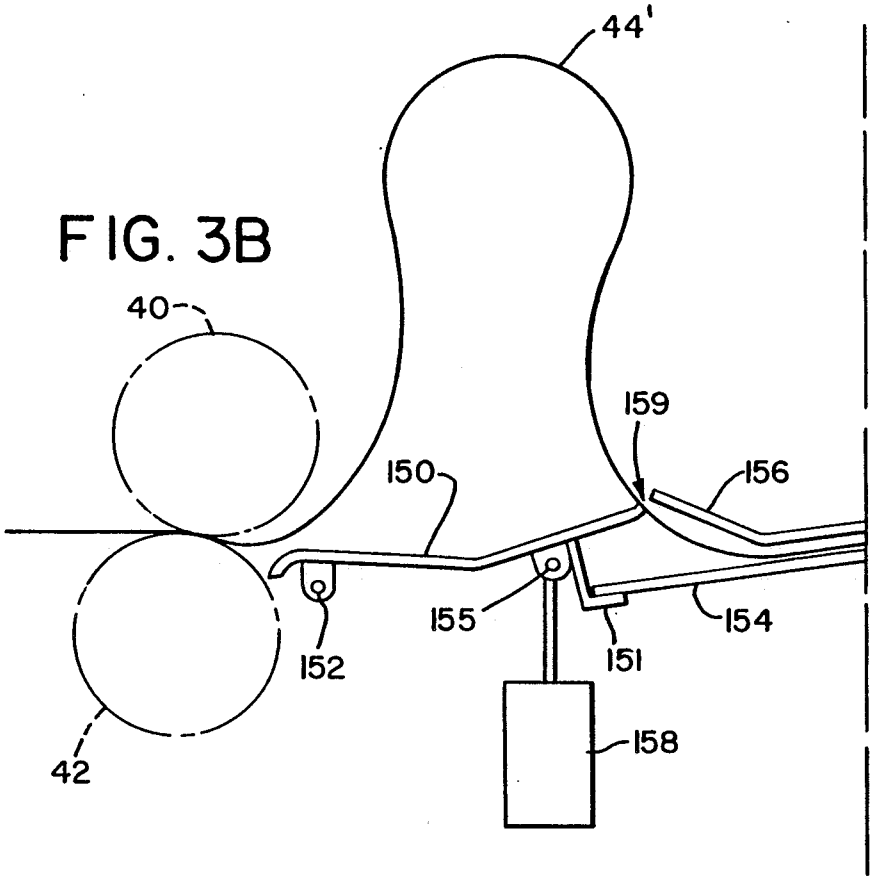
FIGS. 3A and 3B are partially schematic cross-sectional views of portions of the mechanism of FIG. 2, illustrating different operational conditions of the mechanism.
Figure 3A:
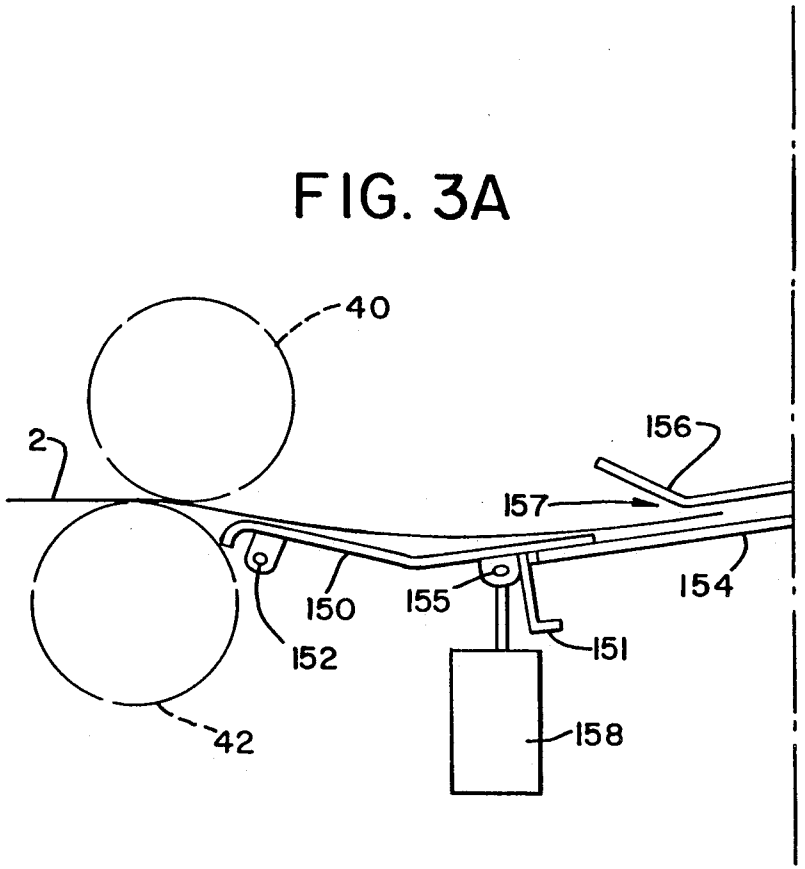

When it is desired to start the imaging process, the entrance 157 to the output cassette 6 is opened by energizing the solenoid 158 to lower the deflector plate 150 to the position shown in FIG. 3A. Also, the motor (not shown) driving the spool in the output cassette 6 is energized.

Next, the image formation process starts. For example, light traveling along the path 48 (FIG. 2) forms images at the exposure station 8. Typically, the images will be spaced from one another across the width of the film by an image spacing mechanism or deflection device, an example of which will be disclosed in the following text. The film is transported gradually in the forward direction F as the images are formed, one band or laser brush stroke at a time. The film moves intermittently between laser brush strokes, but moves at a high speed. The invention also is applicable to machines using continuous motion of the film during composition.

As the leading edge 45 (FIG. 2) of the film moves forwardly, it enters the inlet 157 of the output cassette 6, and is wound on the spool in that cassette.

The film transfer from loop 46 to the output cassette continues until a predetermined "take" length of film has been processed. For example, this length might be the length of a newspaper page, or the length of a film section upon which several pages of a book are composed. At this point, prior to a new run, the output cassette motor is de-energized, and the solenoid 158 is energized to raise deflecting plate to its operative position, as shown in FIG. 3B, in order to prevent the unexposed film from entering the output cassette, and to urge the film being fed forward to form a new loop.

As it is shown in FIG. 3B, the release of solenoid 158 causes the lip 153 of plate 150 to move the adjacent part of the film toward lip 156 of the cassette. The gap 159 left between the two lips is just wide enough to accommodate the passage of the film without objectionable constraint.

Next, the film is moved forwardly by a predetermined distance, thus forming a new output film loop 44', as shown in FIG. 3B. Then, the film is reversed to form a new loop 46 (FIG. 2), and the imaging process is repeated for a new "take".

For each new "take" of film the sequence is repeated by first feeding the film forward in order to form a loop on the output side, followed by a reverse motion to transfer the loop to the input side, and then gradually advancing the film forward as it is exposed.

For the production of multiple columns by reverse leading, or multiple pages of a book by "imposition", the operation is similar, but the entrance to the output cassette remains shut while the forward-backward operation is repeated as often as necessary to produce the multiple columns or pages.

The imaging can occur either when the film is moved in the forward direction, that is, towards the output cassette, or in the reverse direction, or in both directions. In the latter case, columns or pages will be produced alternatingly from the top, during forward movement, or from the bottom, during reverse movement. The columns are formed lengthwise on the medium. Preferably, the automatic margin and feed control operate continuously during any movement of the film to maintain accurate film placement at all times during composition.

After the initial loading of the film, the film is held against a roller 38 (FIG. 2) which acts as a platen. This is done by the rollers 40 and 42. The centers of rollers 40 and 42 are aligned along a line 43 which is rotated clockwise from vertical. This bends the film slightly downwardly and cause the film to bow upwardly and make intimate contact with the platen roller 38. This increases the rigidity of the film at the exposure station 8 without substantially affecting its location in the imaging plane. This also guides the leading edge 45 of the film downwardly to ensure it enters the output cassette inlet 157.

DRIVE UNIT

FIG. 4 shows the structure of the right-hand drive unit 12. To the drive motor 26 is attached a tachometer 51 and a speed reducer shown schematically at 52. Secured to the drive shaft 56 of the motor 26 is the drive roller 24. This assembly is rotatably mounted in a frame 54. Frame 54 is pivotally mounted at 60 to a support frame 68 which is secured to the main frame 72 of the machine.

An arm 64 projects to the right from the Frame 54. A cam 66 is mounted on a shaft 67 which extends across the width of the machine. A coil spring 62 is fastened between the frames 54 and 68 to urge the pivotable frame downwardly and thus press the drive roller 24 against the pinch roller. The cam 66 is rotated to lift the arm 64 to disengage the drive roller 24 from the pinch roller 28 and at the same time move the roller 42 away from the film path, to facilitate the introduction of a new film, as explained above. The pull of the spring 62 is accurately selected to produce a predetermined pressure between the drive roller 24, the film 2 and the pinch roller 28, taking into account the coefficient of friction of the rollers and the film.

The driving unit base frame 68 supports the shaft position encoder 30 which is drivably coupled to the pinch roller 28 by a shaft 69. The frame 68 also has an L-shaped vertical support to which is attached the film supporting plate 35. The frame 68 is releasably attached by screws 67 and a dowel pin 70 or otherwise to the main frame 72 of the machine at different locations in order to accommodate film of different widths. The dowel pin 70 insures the accurate positioning of the drive unit.

MARGIN CORRECTION

The method utilized for the correction of the left margin location of the medium will now be described with reference to FIGS. 1 and 5 to 11.

In the case where a film supply cassette is utilized, there is a certain amount of "play" between the roll of film inside the cassette and the end walls of the cassette so that the film emerging from the cassette can wander in the lateral direction. Also, there is a continuous variation between the desired position and the actual position of the film margin, which is unacceptable for high-quality imaging of text, graphic matter and halftone images such as required in high-quality photocomposition.

These problems are illustrated in FIGS. 5A and 5B in which a conventional feed roll is shown at 74.

In FIG. 5A the film is skewed at an angle relative to the feed direction represented by arrow F2.

FIG. 5B shows a point 75 on the edge 3 after the film has advanced in the direction F2 by a length "d". The lateral position of the point 75 has shifted on the roller by a distance $\Delta X$ resulting from the fact that the margin deviates from the desired direction by the angle $\theta$. Any further advance of the film will shift it further to the right relative to the roller. This behavior is at the origin of "film jams" in the output cassette, as it is well known in the art. Such jams can damage one edge of the film, and cause the film to wander.

It is one of the objects of the invention to prevent such problem and at the same time to ensure highly accurate lengthwise film motion.

Referring again to FIG. 1, in accordance with the present invention, the skew is corrected by selective operation of the drive units 10 and 12. If, for example the left driving unit 10 is operated so that the feed roller 16 rotates clockwise, in the direction of the arrow F3, while the right unit 12 is idle, the film will tend to rotate clockwise around feed roller 24 so that the section of the film located upstream relative to the arrow F3 will tilt to the right and the section downstream will tilt to the left.

The same result would be obtained by rotating the right drive roller 24 counterclockwise while the unit 10 is idle. If, in the foregoing examples the direction of rotation were reversed, the results also would be reversed.

By the judicious use of the film-rotating capability of the system jointly with the normal film feed it is possible to correct any skew and/or to bring the left hand margin 3 of the film very close to its pre-established ideal location.

The skew correction process is a triangulation process, which will be explained with the assistance of FIG. 6.

Figure 6:
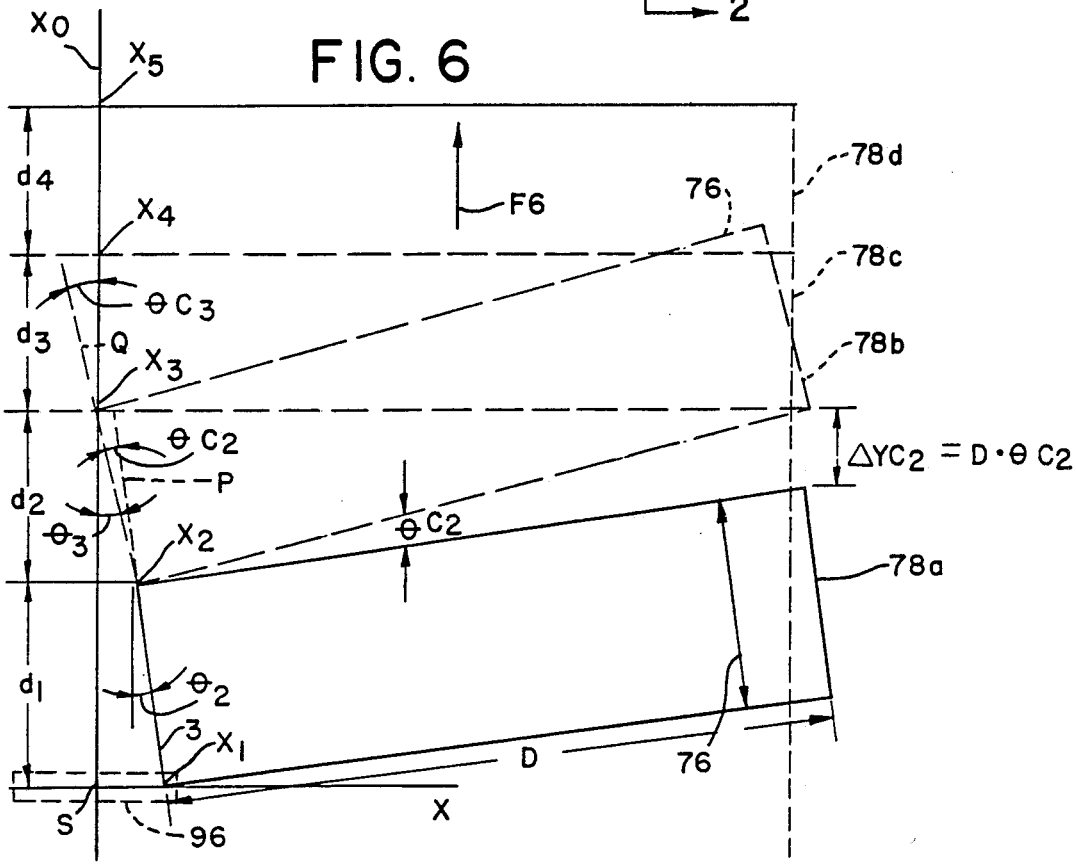
FIG. 6 is a schematic diagram representing the path followed by the film during the correction process of the present invention.

FIG. 6 shows the different locations of a film section 76 with its position and orientation as they are gradually corrected. It is assumed that the film is fed in the direction of arrow F6. The ideal left margin is shown at X0 and is defined relative to the center point of the photosensitive area of the photodetector in the optical edge detector 14, as it will be explained below.

A signal is generated by the photodetector 96 of the optical detector 14 representing the actual distance X of the film margin 3 from the reference line X0 as it intercepts the light impinging on it. The center of the photodetector 96 is shown at point S in FIG. 6.

When the film is advanced by a distance d, it is assumed that, because of the skew, the edge of the film will move to the left to a distance X2 from X0. We will assume that these reference numbers represent also their distance to the ideal margin X0. With these assumptions, the angular orientation of the film can be determined by the following equation:

$$\tan \Theta 2 = \frac{(X_2 - X_1)}{d} \quad (1)$$

In which $\theta 2$ is the angle with the line X0 at which the left edge 3 of the film travels when moving a distance $d_1$.

Knowing $\tan\theta 2$ and position X2, it is possible to determine the new orientation to give to the film so that after it has moved again by distance $d_2 = d_1$, the edge of the film at point X2 will reach position X3, located on or very close to the ideal reference margin, although the actual film margin is still skewed.

Following this new film advance, $\tan \theta$ is re-computed by the following equation:

$$\tan \Theta 3 = \frac{(X3 - X2)}{d} \quad (2)$$

In which $\theta 3$ is the angle in which the left edge of the film travels in moving the distance $d_2$.

Next, the angular position is corrected again so that following a new advance $d_4$, X4 will be on the desired location. At this point, $\tan\theta = (X4 - X3)/d$. Since $X3 = 0$ and $X4 = 0$, $\tan \theta 4 = 0$, and the film is accurately aligned with the reference line X0.

The original orientation of the film is shown at 78*a*. The equation for the displacement of the right edge of the film which is necessary to correct the film orientation is as follows:

Let ΔYC2 be the approximate value of the displacement in the longitudinal direction of the right edge of the film necessary to align the left edge 3 of the film along a path Q calculated to move the film edge from $X_2$ to $X_3$ after moving the distance $d_2$.

Let "D" be the distance between the drive rollers 16 and 24 (See FIG. 1). In FIG. 6, it is assumed that the drive rollers are at the edges of the film, for the sake of illustration.

Let $\theta C2$ be the angle between the line Q and line P, which is the path which the edge 3, would appear to the photodetector 96 to follow were the film to continue on the path it was following originally.

Because the angle $\theta C2$ usually is very small, the following approximation can be made:

$$\tan \theta C2 \cong YC2/D \quad (3)$$

$$\Delta YC2 \cong D \tan \theta C2 \text{ m}(4)$$

Since, for very small angles, the tangent of an angle is approximately equal to the angle itself, expressed in radians. $\tan \theta C2 = \theta C2$, and:

$$\Delta YC2 \cong D\ \theta C2 \text{ (radians)} \quad (5).$$

This displacement ΔYC2 is produced by increasing the distance the film is moved by the right drive unit 12 while leaving the movement produced by the left drive unit 10 unchanged. The orientation of the film section 76 after the displacement ΔYC2 is shown at 78*b*; the orientation after the second correction is shown at 78C; and the final orientation is shown at 78*d*. The same computation and similar corrections preferably are made for each subsequent movement of the film.

The correction process is general and can be used with any initial position and orientation of the film, as long as its margin 3 is located above the active surface 96 of the photodetector.

Preferably, the distance d moved between successive corrections is relatively small, e.g. 62 millimeters. After each step, a very small angular deviation will remain. That deviation is well within acceptable tolerances. Thus, the actual margin oscillates very slightly along the theoretical margin line X0.

In practice, each correction preferably is obtained by the actuation of both drive units 10 and 12, instead of only one drive unit. It can be shown that the angular correction to be made following each advance d by actuating both drive units simultaneously is given by use of the following equation:

$$\tan \theta c \cong \frac{(2X_{n+1} - X_n)}{d} \quad (6)$$

where $\theta C$ is the correction angle, and n = the number of correction steps, each involving movement of the film by the distance d. It also can be shown that the displacement to be produced by each of the drive units will be approximately:

$$\Delta Y - \frac{D}{2d}(2X_{n+1} - X_n) \quad (7)$$

For any given length of film L, the actual correction process of the invention, using both drive units, is illustrated by FIGS. 7 and 8 and the flowchart of FIG. 11.

Figure 10:
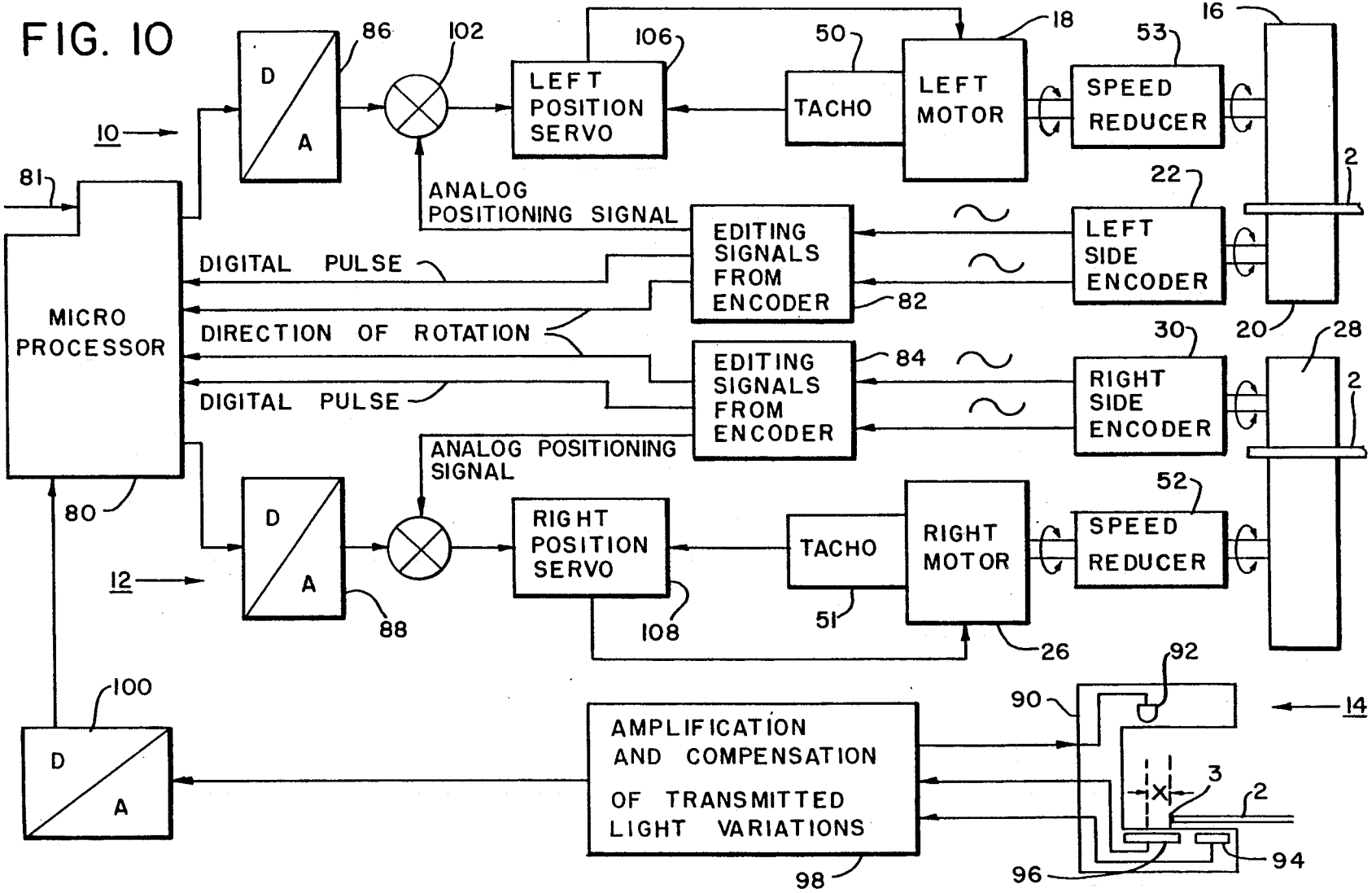
FIG. 10 is a block diagram showing the different components of a film drive unit and how they cooperate to accomplish a correction.

In the example shown in FIG. 7, the left edge of the film is initially aligned with the line T at a distance $X_1$ from the center S of the photodetector surface. The control system which is to be described below and is shown in FIG. 10, includes a microprocessor programmed to execute the program illustrated in FIG. 11.

For a give length L of film, the number of steps m to be used in the correction process is calculated by the equation:

$$m = \left| \frac{L}{d} \right| \quad (7)$$

At the first step, where n, the number of the step, $=1$, $X_n$ is measured. Here, $X_n=X_1$.

Then the deviation $\Delta Y$ is computed. In the first step, where $X_n=X_1$, $X_{n+1}=0$ and $$\Delta Y = -\frac{D}{d}(-X_1)$$

and $$\Delta Y = -\frac{DX_1}{d} \quad (8)$$

Now the right and left drive increments are computed as, indicated in FIG. 11, and the correction is executed by rotating one drive roller clockwise and the other counterclockwise, as indicated in FIG. 8, to align the left edge of the film along line U (FIG. 7). The film has been rotated through an angle $\theta$C1. The polarity of this angle is plus, according to the convention noted in FIG. 7.

Now, as indicated in FIG. 11, the film is moved in the direction F6 (FIG. 7) by a distance d. The edge of the film is now at a distance $X_2$ (FIG. 7) from the reference line Referring again to FIG. 11, the computer now compares the number n with the number m. If n is less than m, indicating that further steps are to be performed, the computer executes a routine to increment n by one and then repeat the correction process.

This time, $X_{n+1}=X_2$, and the correction value is given by this equation:

$$\Delta Y = -\frac{D}{d}(2X_2 - X_1) \quad (9)$$

The correction is executed, swinging the left edge of the film through an angle $\theta C_2$, which is minus, indicating that the film is rotated in the direction opposite to that of the first correction.

The correction process then is repeated. $X_{n+1}=X_3$, which has been set at zero. Therefore;

$$\Delta Y = -\frac{D}{d}(2X_3 - X_2) = \frac{D}{d}(X_2) \quad (10)$$

The film now is rotated clockwise through an angle $\theta$C3 to align the left edge of the film on the reference line $X_0$.

The process then continues until n=m, and the film is moved a final increment "1" to complete its displacement.

Table 1 which follows gives the values of tan $\theta$ at various points in the process of FIGS. 7 and 11, as well as various parameters of a device which has been built and successfully tested in accordance with the present invention:

TABLE 1

| Position | Before Correction | After Correction | Correction Value (Tan $\theta$C) |
|---|---|---|---|
| X1 | | $\frac{X1}{d}$ | $\frac{+X1}{d}$ |
| X2 | $\frac{X1 - X2}{d}$ | $\frac{X2}{d}$ | $\frac{2X2 - X1}{d}$ |
| X3 | $\frac{X2 - X3}{d}$ | $\frac{X3}{d}$ | $\frac{2X3 - X2}{d}$ |

TABLE 1-continued

| $tg\ \Theta_{n-1}$ ($tg\ \Theta C = tg\Theta_n - tg\theta_{n-1}$) | $tg\ \Theta_n$ | $tg\ \theta C$ |
|---|---|---|
| Determination of sensor parameters | | |
| A/D converter: | 8 bits | |
| Detector length: | 6 mm (5.6 mm is the effective length) | |
| Resolution: | 5.6/256= 0.022 mm per increment of the A/D converter. | |
| Distance between measures: | d= 62 mm. | |
| Distance between metering rollers: | from 80 to 440 mm=D | |
| Film feed and correction increment at the roller level: 44 microns. | | |
| $\frac{D}{d}\ \frac{(2X - X)}{\text{increment}}$ : | (correction increment = 44 microns) | |
| Referring now to figure 9: $NX_n$ = value delivered by the converter for measure. | | |
| Total number of steps for correction: | $\frac{D}{2d}(2NX_n - NX_{n-1})$ | |
| Number of steps of left motor: (left relative to film advance) | $\frac{N\ steps + 1}{2}$ | |
| Direction: - (sign of N steps) | N steps > 0 : backwards<br>N steps < 0 : forward | |
| Number of steps of right motor: | $\frac{N\ steps}{2}$ | |
| Direction: (sign of N steps) | N steps > 0 : forward<br>N steps < 0 : backwards | |

Table 2 below shows the actual correction values for a film corrected using the process described above and in FIGS. 7, 8 and 11, and Table 1:

TABLE 2

Example
x1 = 1. mm tan = 4.3.10 D = 300 mm d = 62 mm

| Measure | $X_1$ (meters) | N steps | Left Motor | Right Motor | tan |
|---|---|---|---|---|---|
| 0 | $1 \times 10^{-3}$ | 108 | R 54 | A 54 | $1.15 \times 10^{-2}$ |
| 1 | $2.8 \times 10^{-4}$ | −50 | A 25 | R 25 | $4.2 \times 10^{-3}$ |
| 2 | $2.4 \times 10^{-5}$ | −24 | A 12 | R 12 | $6.8 \times 10^{-4}$ |
| 3 | $-1.88 \times 10^{-5}$ | −2 | A 1 | R 1 | $3.9 \times 10^{-4}$ |
| 4 | $-4.32 \times 10^{-5}$ | −4 | A 2 | R 2 | $-1.93 \times 10^{-4}$ |
| 5 | $-3.12 \times 10^{-5}$ | −2 | A 1 | R 1 | $-4.86 \times 10^{-4}$ |
| 6 | $-1.09 \times 10^{-6}$ | 2 | R 1 | A 1 | $-1.93 \times 10^{-4}$ |
| 7 | $1.1 \times 10^{-5}$ | 0 | 0 | 0 | $-1.93 \times 10^{-4}$ |

The foregoing shows that the present invention provides a relatively large first correction step, followed by smaller steps, which brings the film into proper alignment relatively quickly. In Table 2, it can be seen that the left edge of the film is brought to within 0.024 mm from the reference line X0 in only two movements, by a total distance of 2d, from a starting position 1 mm away.

ELECTRICAL CONTROL CIRCUIT

The control circuit shown in FIG. 10 includes the optical detector 14 whose output is delivered to an amplification and compensation circuit 98, an analog-to-digital converter (ADC) 100, a microprocessor 80 having an input terminal 81; the left side drive unit comprising a digital-to-analog converter (DAC) 86, a combining means 102, a left position servo control 106, the drive motor 18, a tachometer 50, a speed reducer 53, and the left drive roller 16. Also included in the drive unit 10 are the pinch metering roller 20, the shaft position encoder 22, an editing circuit 82. The right side drive unit 12 comprises a digital-to-analog converter (DAC) 88, combining circuit 104, a right position servo control 108, the drive motor 26, the tachometer 51, the speed reducer 52, the right drive roller 24 the pinch metering roller 28, the position encoder means 30, and an editing circuit 84.

Referring to the lower right-hand portion of FIG. 10, the optical detector 14 includes a c-shaped support structure 90, a light-emitting diode (LED) 92 in the upper arm of the support structure, and two photodiode sections 94 and 96 in the lower arm of the structure. The LED produces infrared light beams whose intensity can be adjusted depending on the relative opacity of the film medium 2.

The film 2 covers all of the photodiode section 94 and part of the section 96. The inner photodiode section 94 detects light transmitted by the film from the LED, and therefore produces a signal whose magnitude is a function of the opacity of the film. The photodiode 96 produces a signal proportional to the portion of the photodiode which is not covered by the film, and thus indicates the relative location of the film margin or edge 3.

The signal from the photodiode 94 is sent to the amplification and compensation circuit 98 which changes the light output from the LED to maintain a constant output from the photodiode 94 despite variations in opacity of the film. This minimizes the effect of the changes of film opacity on the output of the photodiode 96 so that its output will accurately represent the location of the film edge at all times.

The light emitted by the LED is in the infra-red range, and the film 2 is not sensitive to light in that range. Therefore, the emissions from the LED do not "fog" the film 2.

Still referring to FIG. 10, the edge-position indicating analog signal output from the circuit 98 is delivered to the analog-to-digital converter 100 which converts the analog signals into digital form and delivers them to the microprocessor 80.

The microprocessor 80 is a standard circuit element such as an Intel Model 8085. It receives programming for each individual photo typesetting job on the input line 81. This programming enables the microprocessor to control the movement of the film in synchronism with the image placement mechanism (not shown in FIG. 10) to form images on the film in transverse lines.

The microprocessor also is programmed to perform the correction algorithm of FIG. 11 using the signals from the analog-to-digital converter 100 and the position and direction of rotation signals from the position encoders 22 and 30 by way of the "editing" circuits 82 and 84. Circuits 82 and 84 are waveform shaping circuits.

Since the operation of each of the drive units 10 and 12 is substantially identical to the other, the operation of only one of the drive units, drive unit 10, will be described here and it will be understood that the operation of the unit 12 is essentially the same.

The position adjustment signals for the drive unit are sent from the microprocessor 80, where they are computed, to the digital-to-analog converter 86, which delivers corresponding analog signals to a multiplier circuit 102 which combines those signals with analog positioning signals from the left-side encoder circuit through the unit 82.

The output from the multiplier circuit 102 is delivered to the left position servo control unit 106 which receives a feedback signal from the tachometer 50 coupled to the left drive motor 18 and controls its speed in accordance with a program designed to create the desired motion in the shortest time.

The left drive motor 18 drives the drive roller 16 through the speed-reducer 53, and the left-side shaft position encoder 22 delivers position-indicating signals back to the microprocessor and the multiplier circuit 102.

If the motion of the film is to be intermittent, as preferred, the encoder 22 will tell the microprocessor when the desired stopping point has been reached, and it will instruct the left drive motor to stop at the appropriate place.

The correction signals are merely subtracted from or added to the signals to the respective drive motors 18 or 26 to increase or decrease the motion they produce by the amount desired to perform the necessary margin correction.

Preferably, the encoders 22 and 30 are conventional shaft-position encoders. The encoders can be of the type utilizing a disk with multiple thin radial slots moving past a stationary lamp and photocell combination, plus a counter to count pulses produced by the lamp and photocell combination to detect the amount of movement of the disk. Ramping is used to achieve resolution in the micron range.

Preferably, the circuits 82 and 84 utilize the position information from the encoders 22 and 30 to develop digital pulses indicating the degree of shaft movement and the direction of rotation, as well as an analog positioning signal to operate the drive motor.

As explained above, the photodetector 96 delivers a signal proportional to the lateral position of the film. This signal, preferably converted into a binary number by the A/D converter 100, is detected for each incremental advance of the film.

Referring now to FIG. 9, as well as FIG. 10, assuming that the width of the area of the photodetector 96 as measured in a direction orthogonal to the film, is 256 units (one unit can conveniently be 22 microns) the center of the area is at 128 units, and is taken as the location of the line X0. The location of the margin can be at position NXm=255, too far to the right, or at position NXm=128, centered, or at position NXm=0, too far to the left.

CARRIAGE STRUCTURE

In a preferred embodiment, the machine utilizes a novel carriage structure 200 which will now be described with reference to FIGS. 12 to 14. The carriage can be used in character placement in the manner shown in U.S. Pat. No. 4,746,942 referred to above. FIG. 12 is a cross-sectional plan view, with the cross-section being taken along line 12—12 of FIG. 13, and FIG. 13 is a cross-sectional view taken along line 13—13 of FIG. 12.

The carriage is made of a very light material, such as aluminum, and its structure gives excellent rigidity for such light weight. The carriage body 201 (see FIG. 13) carries optical projection elements 202, such as a focusing lens and a reflector which are used to project images onto the film 2 in the manner more completely described in U.S. Pat. No. 4,746,942.

The carriage drive mechanism is shown schematically in FIG. 12. The drive mechanism includes a drive motor whose pulley 220 engages a carriage drive belt or wire 218 attached to the carriage. The drive belt 218 engages a pulley 222 of a shaft position encoder. A spring-loaded idler 224 engages the drive belt 218 to keep it tightly engaged with the pulleys 220 and 222.

The body 201 has two legs with elongated flat bottom members 206 and 207. Magnetic slider pads or buttons 211, 212 and 213 are secured to members 206 and 207. The magnetic buttons serve as bearings which seat the carriage squarely and firmly on the rigid, polished cast iron base 208 of the machine. The purpose of this arrangement is to hold the carriage down against the surface of the base 208, thus avoiding any slight up and down motion of the carriage as it moves.

In order to prevent any sideways motion, the carriage body 201 has a downwardly-extending rib 204 on which magnetic buttons 214 and 215 are secured. These buttons are attracted to a polished, rigid upstanding rib 210 of the cast iron base 208 of the machine.

The carriage structure described above minimizes the amount of "play" of the carriage and provides a very high positioning accuracy in the placement of character or picture elements. Furthermore, the carriage can be subjected to high acceleration or deceleration forces with very little or no vibration because of its light weight, great rigidly, and controlled friction.

FIG. 14 is an enlarged view of a portion of FIG. 13 showing the magnetic button assembly 212. The button 212 has a permanently-magnetized body of ceramic material, and a stem 217 which is used to secure the button to the carriage member 207 by force-fitting or cementing the stem 217 into hole. A wafer 216 of low-friction material is secured to the bottom of the body of the magnetic button by adhesive or other means. A predetermined amount of friction is obtained by the combination of the force of magnetic attraction and the thickness of the wafer. As an example, the low friction material of the wafer 216 is a prelubricated gum resin acrylate sold by 3M under the designation "5425" in ribbon form with an adhesive coating. The adhesive coating is used to adhere the wafer to the body of the button.

The wafer 216 is relatively thin, e.g. 0.11 mm, so as to keep the magnetic button close to the iron base 208 so as not to lose too much magnetic force of attraction by creating a large gap in the magnetic circuit formed between the magnet and the base. The magnetic force of attraction and, hence, the friction between the buttons and the base can be regulated by regulating the thickness of the wafer 216.

Although in the preferred embodiment of the invention the carriage carries optical elements and the recording surface is photographic film, the carriage also is advantageous in use as a carrier for other types of image formation structures or elements for forming images on other media. For the purposes of such further embodiments of the invention, the structure indicated by reference numeral 202 is to be considered to be a print head for an ink-jet printer, or a dot-matrix printer, or a light-emitting-diode ("LED") array printer, or for any other type of printing, photocomposing or image-forming device in which image-forming means are scanned over a surface on which images are to be formed.

Also, the film 2 can be other image-forming media, such as plain or coated paper, plates, etc.

It should be understood that it is preferred that the carriage and image-forming means 202 be located below the image-receiving surface, as indicated in FIG. 13. Thus, the force of gravity aids in holding the carriage on its guide.

The structure shown in FIGS. 12–14 provides a surprisingly smooth, long-lasting carriage structure. The prelubrication of the wafer material and the cast iron of the base avoids the need for lubrication during use, and gives the mechanism excellent wear characteristics.

Many changes, modifications, variations and other uses and applications of the present invention will become apparent to those skilled in the art, and these can be adopted without departing from the spirit of the invention.

We claim:

1. A precision transport system for accurately moving a photosensitive medium, said system comprising, in combination, drive means for moving said photosensitive medium in a predetermined alignment relative to a first reference line, detection means for detecting the position of a second reference line on said medium and producing corresponding electrical signals, and correction means responsive to said electrical signal for correcting the direction of travel of said medium relative to said first reference line.

2. A system as in claim 1 in which said second reference line is one edge of said medium, and said detection means comprises photodetector means for producing an electrical signal which is a function of the distance of said edge from a predetermined position on said photodetector.

3. A system as in claim 2 in which said photodetector has a photosensitive surface extending for a substantial distance in a direction transverse to said edge of said medium, a radiation source means for emitting radiation of a wavelength to which said photosensitive surface of said photodetector is sensitive, the magnitude of said electrical signal being a function of the portion of said photosensitive surface covered by said medium.

4. A system as in claim 3 in which said medium transmits at least a portion of the radiation it receives from said source, and said photodetector means has a second photosensitive surface positioned to receive radiation from said source and produce a calibration signal, said second surface being located transversely inwardly from said first photosensitive surface so as to be covered by said photosensitive medium at substantially all times when said medium is being moved, and electrical means for varying the intensity of the radiation output from said source so as to keep said calibration signal substantially constant despite variations in the opacity of said medium to said radiation, thereby minimizing the change of electrical output from the first photosensitive surface of said photodetector means due to such opacity variations.

5. A medium transport system as in claim 3, in which said photosensitive medium is not responsive to radiation of the wavelength emitted by said source.

6. A medium transport system as in claim 1 in which said detection means is adapted to detect the position of said second reference line relative to said first reference line at two points in time, and including triangulation means for using the position information so produced to determine the angle which said second reference line makes with said first reference line, said correction means being responsive to signals representing said angle to make one or more corrections to bring said second reference line into said pre-determined alignment.

7. A system as in claim 1 in which said drive means consists of two independent drive units spaced apart from one another transversely of the direction of movement of said medium, and means responsive to said electrical signals to operate said drive units differentially to correct the alignment of said medium.

8. A system as in claim 7 in which said second reference line is one edge of said medium, and said detection means measures the distances of said edge from said first reference line at two different times, and including means for developing and delivering to said drive means differential drive signals whose magnitude is a function of the difference between said distances and whose polarity is such as to re-align said edge towards said first reference line.

9. A system as in claim 8 in which each of said drive units includes a drive motor drivably coupled to a drive roller and a driven roller driven by the movement of said medium, shaft position encoding means coupled to said driven roller, servo control means including means responsive to the output of said encoding means for controlling the energization of said drive motor, and computer means for repeatedly computing said differential drive signals after small successive increments of motion of said medium.

10. A system as in claim 1 in which said detection means includes means for detecting the distance $X_n$ between said lines at a first measurement, and detecting the distance $X_{(n+1)}$ at a second measurement after said medium has moved a distance d, and moving one edge of said medium, after each of said measurements, differentially from the other by a distance which is a function of the quantity $(2x_{(n+1)}-X_n)/d$ in a direction such as to tend to bring said lines into alignment with one another.

11. A medium transport system as in claim 1 in which each of said independent feed means includes a pair of rollers for feeding and metering said medium, said rollers including a drive roller having a relatively high coefficient of friction, and a driven roller pressing against said photosensitive medium and driven by said photosensitive medium, and metering means drivably coupled to said driven roller.

12. A medium transport system as in claim 11 including means for mounting said rollers so as to be selectively urged towards one another in a first position, and separated from one another in a second position.

13. A medium transport system as in claim 11 including means for mounting said independent feed means so that at least one of said feed means is movable in a direction transverse to said medium to selectively accommodate photosensitive media of varying widths.

14. A medium transportation system for accurately moving a photosensitive medium in a given direction, said system comprising, in combination, drive means for moving said photosensitive medium in a first direction, said medium having a first line extending longitudinally on said medium, detection means for detecting the distance of said first line from a fixed reference point at two different points on the line and producing an electrical signal corresponding to said distance at each of said points on said line, and correction means including triangulation means for utilizing said distances to calculate a correction to bring said line to a pre-determined alignment relative to said fixed point.

15. A medium transport system for the accurate positioning of images on a photosensitive medium, said system comprising, in combination, a feeding mechanism for feeding said medium to space from one another image elements produced in lines transverse to the direction in which said medium is moved by said feeding mechanism, said feeding mechanism including two independent feed means spaced apart across the width of the medium, margin error detector means for detecting the deviation of the track followed by said medium from a pre-determined track, and for producing electrical signals for independently energizing said independent feed means in order to maintain the track followed by said medium within narrow limits in order to insure high positioning accuracy of successive ones of said lines.

16. A medium transport system as in claim 15 in which said feeding mechanism includes means for forming a loop of said photosensitive medium upstream of an imaging area.

17. A medium transport system as in claim 16 including means for forming two of said loops, one upstream and one downstream of said imaging area, and means for moving said medium forwardly and backwardly past said imaging area while forming images thereon, alternatingly using and re-forming each loop.

18. A system as in claim 15 in which said system includes a take-up cassette for receiving and storing exposed medium, and in which said feeding mechanism includes means for forming a loop of said photosensitive medium downstream of an imaging area and upstream from said cassette.

19. A system as in claim 15 in which said take-up cassette has an inlet opening, and including gate means for selectively closing said opening to assist in the formation of said loop, said driving means being adapted to move said medium forwardly and backwardly to alternatingly form said loop and return the medium in said loop upstream past said imaging area.

20. A medium transport system as in claim 15 in which said margin error detector means includes a photodetector for detecting the position of one edge of said medium and producing a corresponding electrical signal, and servo control means for operating said feeding mechanism to correct said position.

21. A medium transport method for accurately moving a photosensitive medium, said method comprising the steps of driving said medium in a first direction, measuring the distance of a reference line on said medium from a pre-determined fixed reference at two spaced locations, converting the measured distances into corresponding electrical signals, and using triangulation to determine a correction of said direction so as to align said reference line in a pre-determined relationship to said fixed reference.

22. A method as in claim 21 including the step of correcting the direction of travel of said medium according to the correction determined by said triangulation step by driving each of two spaced-apart independent drive means differentially to change the direction in which said medium is traveling.

23. A method as in claim 22 including the steps of repeatedly performing said measuring step after each of a plurality of relatively small increments and calculating, for each of said steps, an incremental differential movement for each of said independent drive means to create said change in direction.

24. A method as in claim 21 in which said reference line is one edge of said medium, and said measurement step comprises detecting the coverage of an elongated photocell by said edge of said medium as it moves past said photocell and developing a corresponding electrical signal.

25. Transport means for transporting image-forming means for forming images on an image-receiving surface and spacing said images from one another on said surface, said transport means comprising, in combination, a carriage, image-forming means mounted on said carriage for forming images on an image-receiving surface when said carriage is moved transversely to said surface, guide means for guiding said carriage in its movement, said guide means having at least one smooth elongated bearing surface, drive means for driving said carriage along said guide means, and a plurality of spaced-apart bearing members of relatively small surface area separating said carriage from said guide means, each of said bearing members having a broad bearing surface contacting said bearing surface of said guide means and adapted to slide thereon.

26. Transport means as in claim 25 including magnetic means urging said carriage towards said guide means by magnetic attraction.

27. Transport means as in claim 26 including drive means for moving said carriage back and forth along said guide means.

28. Transport means as in claim 26 in which said bearing members are permanently magnetized and said guide means is made of magnetic material.

29. Transport means as in claim 28 in which each of said bearing members has a low-friction bearing surface.

30. Transport means as in claim 29 in which said low-friction bearing surface comprises a thin layer of pre-lubricated plastic material adhered to the under-surface of said bearing member.

31. Transport means as in claim 30 in which the material of said guide means is cast iron.

32. Transport means as in claim 25 in which said guide means includes a pair of said smooth bearing surfaces, spaced apart from one another, and a third smooth elongated bearing surface extending parallel to said pair of elongated bearing surfaces in the longitudinal dimension and transverse to the latter surfaces in the transverse dimension so as to provide both lateral and vertical stability of motion for said carriage, there being at least one of said bearing members between said carriage and each of the three bearing surfaces.

33. Transport means as in claim 30 in which each of said bearing members is a permanent magnet which has a flat bearing surface coated with a low-friction material, and said guide means pearing surfaces are made of a magnetic material.

34. Transport means as in claim 30 including an elongated guide member upstanding from a guide plate having the first two bearing surfaces thereon, said third bearing surface being located on the upstanding guide member.

35. An image placement carriage for carrying image-forming means for forming images on an image-receiving surface, said carriage comprising a movable support structure for supporting image-forming means, and a plurality of relatively low-friction sliding pads secured to and extending outwardly from said support structure to serve as bearing members to support said support structure on carriage guide means and to facilitate movement of said support structure thereon for image formation.

36. A carriage as in claim 35 in which each of said sliding pads is magnetic and is adapted to be attracted to a magnetic guide member on which it bears to hold said support structure against said guide member.

37. A carriage as in claim 36 in which each of said sliding pads comprises a permanent magnet with a relatively thin wafer of pre-lubricated plastic adhered to and forming the bearing surface thereof.

38. Transport means for transporting image-forming means for forming images on receiving surface and spacing said images from one another on said surface, said transport means comprising, in combination, a carriage, image-forming means mounted on said carriage for producing images on said surface when the carriage is moved transversely of said surface, guide means for guiding said carriage in its movement, said guide means having at least one smooth, elongated bearing surface, drive means for driving said carriage along said guide means, and at least one bearing member separating said carriage from said guide means, said bearing member having a broad bearing surface contacting said bearing surface of said guide means to slide thereon, and magnetic means urging said carriage towards said guide means by magnetic attraction.

39. A system as in claim 10 in which said drive means includes a pair of independent drive units for moving said medium at locations spaced from one another transversely of said medium by a distance D, and means for delivering to each of said drive units a correction signal having a magnitude of approximately $D(2x_{(n+1)}-X_n)/2d$ and of a polarity such as to cause one drive unit to move said medium in a direction opposite to the other.

* * * * *